US012276461B2

(12) United States Patent
Lin

(10) Patent No.: US 12,276,461 B2
(45) Date of Patent: Apr. 15, 2025

(54) VAPOR CHAMBER AND SINGLE-PIECE SUPPORT STRUCTURE THEREOF

(71) Applicant: TAIWAN MICROLOOPS CORP., New Taipei (TW)

(72) Inventor: Chun-Hung Lin, New Taipei (TW)

(73) Assignee: TAIWAN MICROLOOPS CORP., New Taipei (TW)

( * ) Notice: Subject to any disclaimer, the term of this patent is extended or adjusted under 35 U.S.C. 154(b) by 267 days.

(21) Appl. No.: 18/130,430

(22) Filed: Apr. 4, 2023

(65) Prior Publication Data

US 2024/0280329 A1 Aug. 22, 2024

(30) Foreign Application Priority Data

Feb. 17, 2023 (TW) ..... 112105866

(51) Int. Cl.
*F28D 15/00* (2006.01)
*F28D 15/02* (2006.01)

(52) U.S. Cl.
CPC ..... *F28D 15/0266* (2013.01); *F28D 15/0275* (2013.01)

(58) Field of Classification Search
CPC ..... F28D 15/0266; F28D 15/0275; F28D 15/0233; F28D 15/046; H05K 7/20336
See application file for complete search history.

(56) References Cited

U.S. PATENT DOCUMENTS 5,427,174 A * 6/1995 Lomolino, Sr. ..... F28D 15/0233 165/104.33
6,269,866 B1 * 8/2001 Yamamoto ..... F28D 15/0233 174/15.2
6,901,994 B1 * 6/2005 Jin-Cherng ..... F28D 15/046 165/185
9,546,826 B1 * 1/2017 Carter ..... H01L 23/427
11,802,739 B2 * 10/2023 Zhou ..... F28D 15/046
2009/0194259 A1 * 8/2009 Meyer, IV ..... F28D 15/04 165/104.26
2010/0294200 A1 * 11/2010 Zhang ..... F28D 15/0233 118/728
2011/0030921 A1 * 2/2011 Zhang ..... F28D 15/046 165/104.21
2011/0168359 A1 * 7/2011 Lin ..... F28D 15/0233 165/104.26
2011/0192576 A1 * 8/2011 Wang ..... F28D 15/0233 165/104.26

(Continued)

*Primary Examiner* — Travis Ruby
(74) *Attorney, Agent, or Firm* — Chun-Ming Shih; HDLS IPR SERVICES

(57) ABSTRACT

A vapor chamber includes a shell body, a wick structure, a single-piece support structure and a working fluid. The shell body includes a first shell and a second shell. A chamber is formed between the first shell and the second shell. The wick structure is disposed in the chamber and attached on the shell body. The single-piece support structure is disposed in the chamber and between the first shell and the second shell, and includes support bodies and ribs. Each support body includes a hollow rod and an annular seat. Any adjacent two of the annular seats are connected by one of the ribs. The support body are arranged at an interval. The ribs are arranged along the support bodies to form hollow portions between each support body and each rib. The working fluid is disposed in the chamber.

10 Claims, 7 Drawing Sheets

(56) References Cited

U.S. PATENT DOCUMENTS

| | | | | |
|---|---|---|---|---|
| 2011/0315351 | A1* | 12/2011 | Meyer, IV | F28D 15/0233 165/104.26 |
| 2012/0325438 | A1* | 12/2012 | Meyer, IV | F28D 15/046 165/104.26 |
| 2013/0032312 | A1* | 2/2013 | Wang | F28D 15/046 165/104.26 |
| 2014/0060793 | A1* | 3/2014 | Sun | F28F 3/12 165/185 |
| 2014/0076995 | A1* | 3/2014 | Wang | H05K 7/20336 137/15.01 |
| 2014/0174700 | A1* | 6/2014 | Lin | F28D 15/046 29/521 |
| 2015/0026981 | A1* | 1/2015 | Yang | H01L 23/427 29/890.039 |
| 2016/0187074 | A1* | 6/2016 | Lin | F28D 15/0233 165/67 |
| 2019/0033006 | A1* | 1/2019 | Vanderwees | F28D 15/0283 |
| 2019/0353430 | A1* | 11/2019 | Narasimhan | F28D 15/0266 |
| 2020/0271390 | A1* | 8/2020 | Rice | F28F 3/08 |
| 2022/0214115 | A1* | 7/2022 | Liu | F28D 15/02 |
| 2022/0243994 | A1* | 8/2022 | Barako | F28F 21/085 |
| 2022/0260323 | A1* | 8/2022 | Machida | F28F 3/086 |
| 2022/0279678 | A1* | 9/2022 | Takahashi | F28F 3/048 |
| 2023/0047466 | A1* | 2/2023 | Jiang | F28D 15/0266 |
| 2023/0417491 | A1* | 12/2023 | Wang | F28D 15/046 |
| 2025/0003696 | A1* | 1/2025 | Wang | F28D 15/046 |
| 2025/0048591 | A1* | 2/2025 | Takahashi | F28D 15/04 |

* cited by examiner

VAPOR CHAMBER AND SINGLE-PIECE SUPPORT STRUCTURE THEREOF

BACKGROUND

Technical Field

The disclosure relates to a cooling technology, particularly to a vapor chamber and a single-piece support structure thereof.

Related Art

A vapor chamber includes a first shell and a second shell, and a chamber is formed therebetween. A support structure is disposed in the chamber. The support structure is used to keep the stability of the chamber space of the vapor chamber so as to facilitate degassing the inside of the vapor chamber to form vacuum state, and then filling a working fluid to the chamber.

The support structure of a vapor chamber includes multiple support rods. Each support rod is independently disposed between the first shell and the second shell at an interval. When manufacturing, the multiple support rods need to be placed inside the first shell and the second shell one by one depending on actual cooling requirements, and then they are fixed by thermal diffusion welding. This makes the process become very complicated. Although the industry proposes a solution, but the evaporated working fluid cannot smoothly flow to the condensing portion because of insufficiency of the vapor channels, so as to cause great reduction of the cooling performance.

In view of this, the inventors have devoted themselves to the above-mentioned related art, researched intensively and cooperated with the application of science to try to solve the above-mentioned problems. Finally, the invention which is reasonable and effective to overcome the above drawbacks is provided.

SUMMARY

An object of the disclosure is to provide a vapor chamber and a single-piece support structure thereof, which make the manufacturing process become simpler and easier, and have sufficient gas channels to provide heat transfer to improve cooling performance.

To accomplish the above object, the disclosure provides a vapor chamber including a shell body, a wick structure, a single-piece support structure and a working fluid. The shell body includes a first shell and a second shell correspondingly sealed with the first shell. A chamber is formed between the first shell and the second shell. The wick structure is disposed in the chamber and attached on the shell body. The single-piece support structure is disposed in the chamber and between the first shell and the second shell. The single-piece support structure includes multiple support bodies and multiple ribs. Each support body includes a hollow rod and an annular seat extending from the hollow rod. Any adjacent two of the annular seats are connected by one of the ribs. The support body are arranged at an interval. The ribs are arranged along the support bodies to form multiple hollow portions between each support body and each rib. The working fluid is disposed in the chamber.

To accomplish the above object, the disclosure provides a single-piece support structure of a vapor chamber. The vapor chamber includes a first shell and a second shell. The single-piece support structure is disposed between the first shell and the second shell, and includes multiple support bodies and multiple ribs. Each support body includes a hollow rod and an annular seat connected to the hollow rod. Any adjacent two of the annular seats are connected by one of the ribs. The support bodies are arranged at an interval. The ribs are arranged along the support bodies to form multiple hollow portions between each support body and each rib.

The disclosure further has the following functions. The annular seat is disposed to surround the hollow rod to make the whole structure have better anti-pressure strength. The arrangement of the open areas provides firm connection for the first shell and the second shell, and make the heat transferring to the main heat source become faster and more efficient.

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
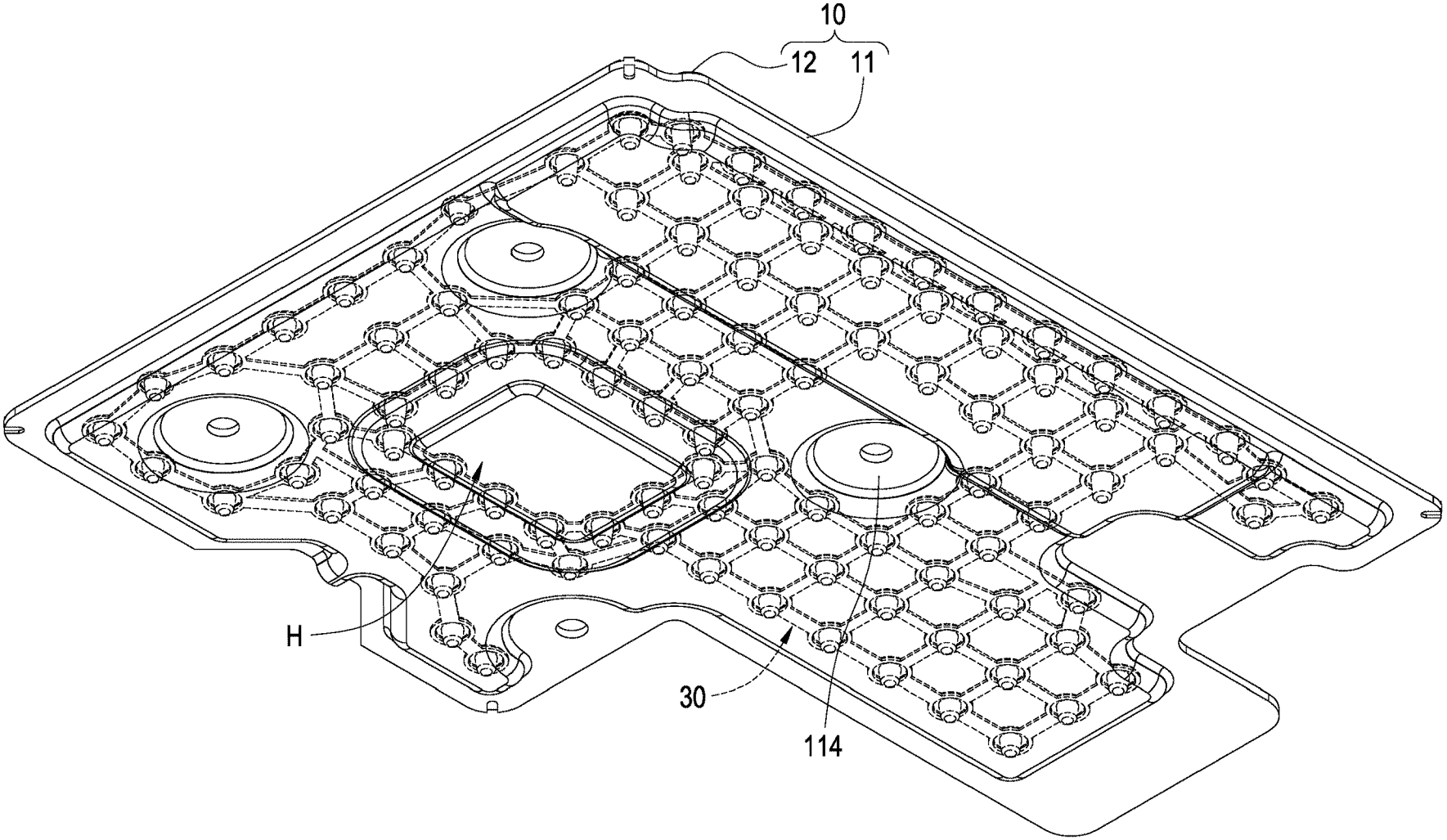
FIG. 1 is an assembled see-through view of the vapor chamber of the disclosure.
Figure 2:
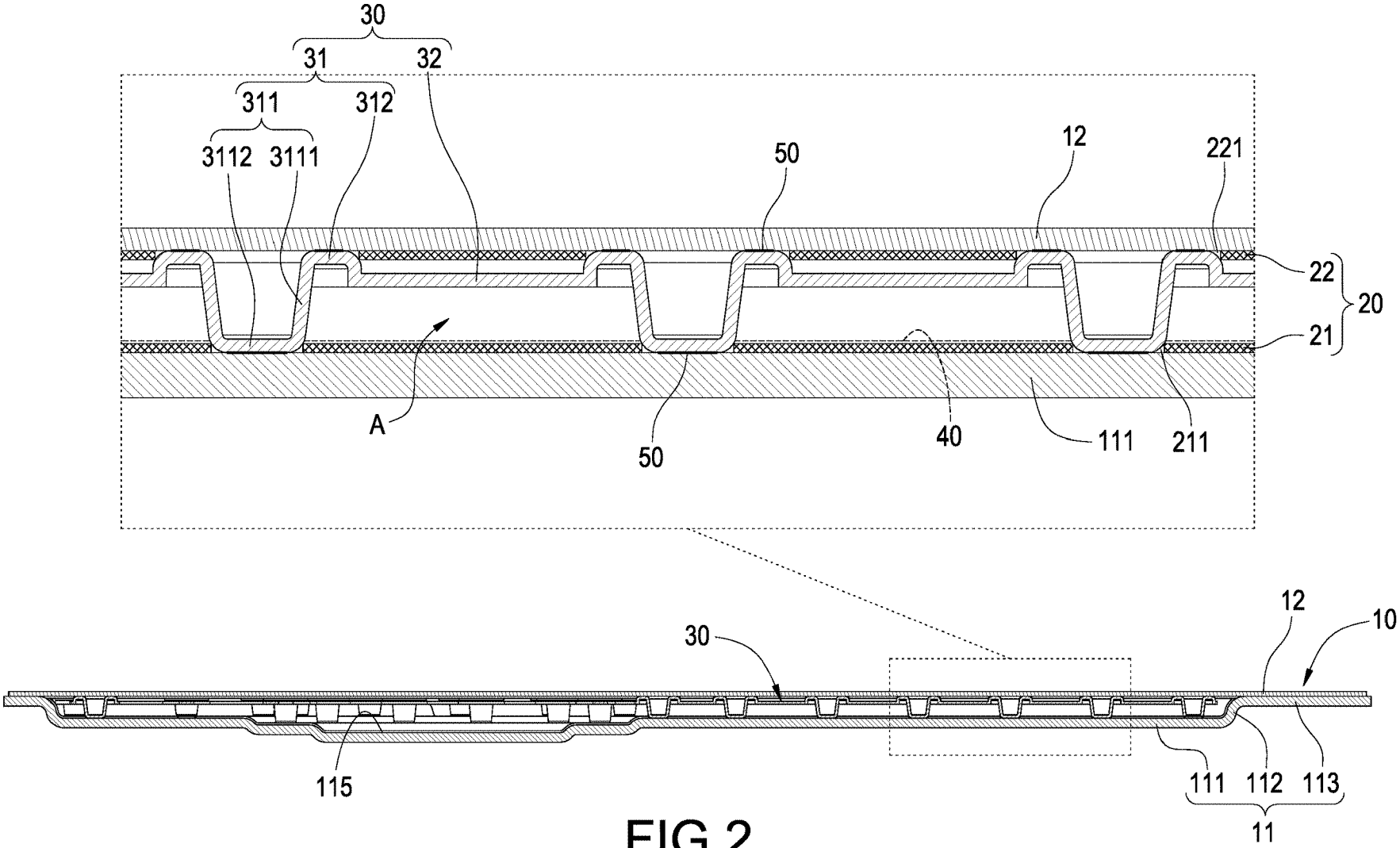
FIG. 2 is an assembled cross-sectional view and a partially enlarged view of the vapor chamber of the disclosure.
Figure 3:
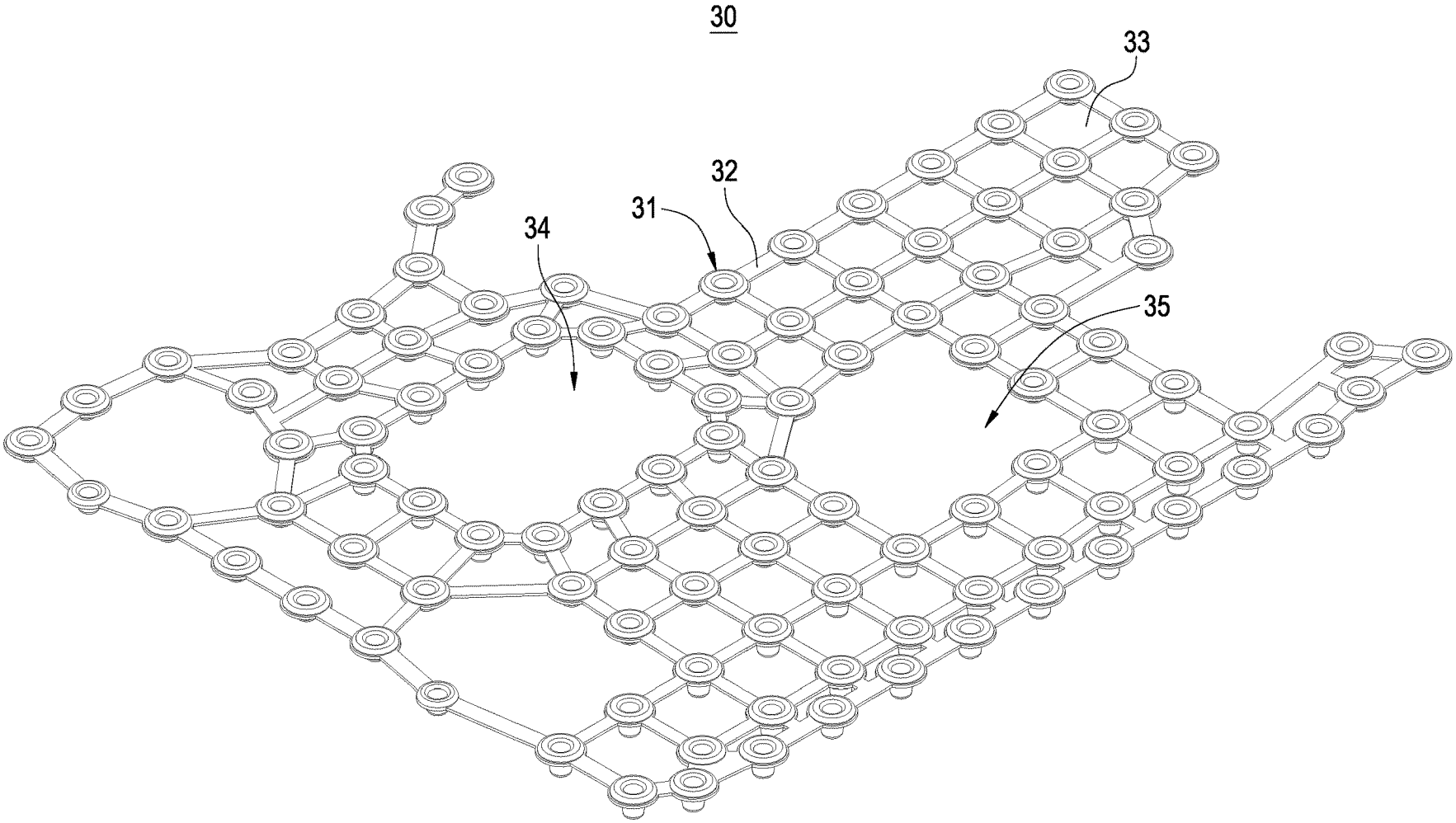
FIG. 3 is a perspective view of the single-piece support structure of the disclosure.
Figure 4:
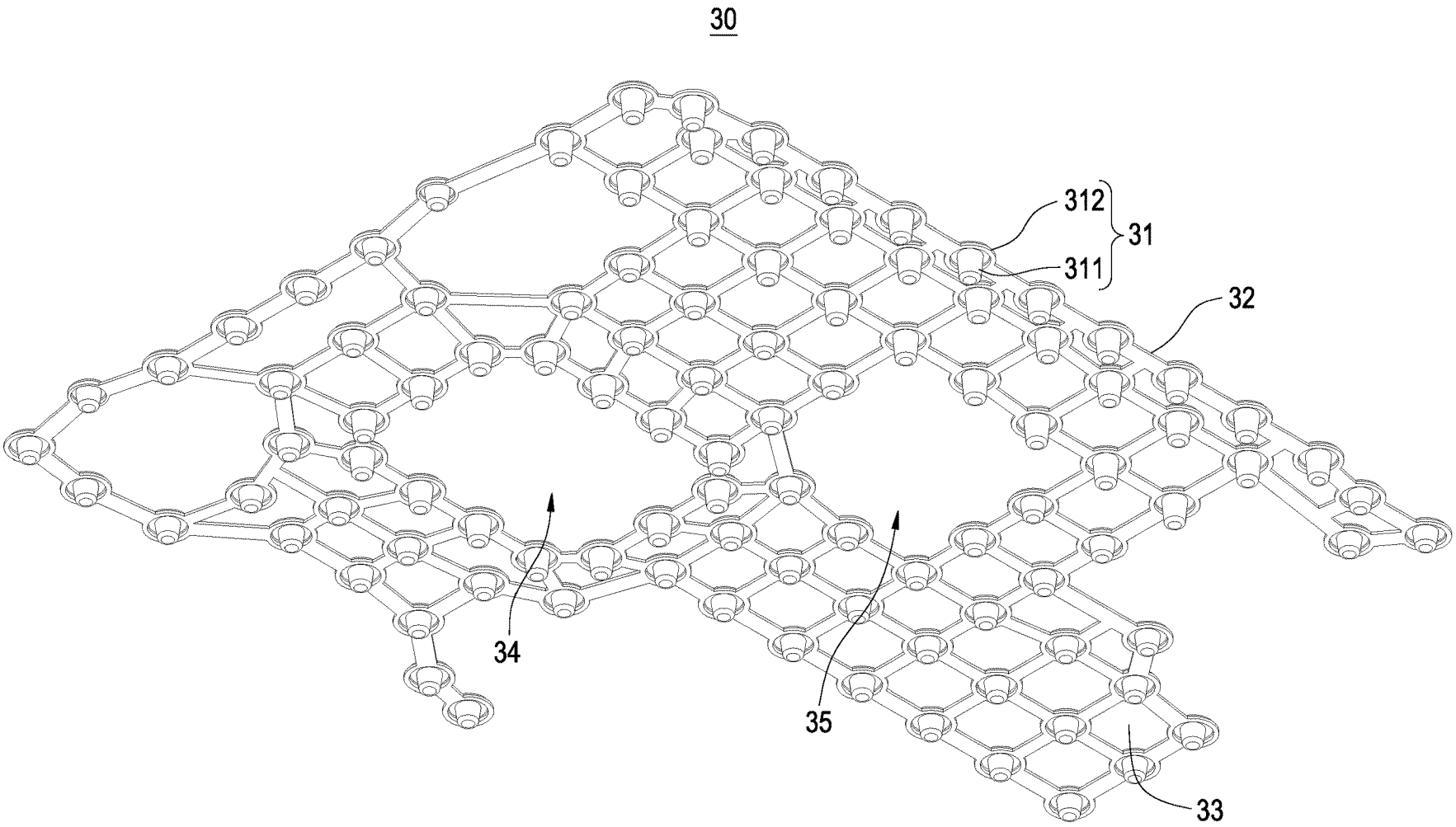
FIG. 4 is another perspective view of the single-piece support structure of the disclosure.
Figure 5:
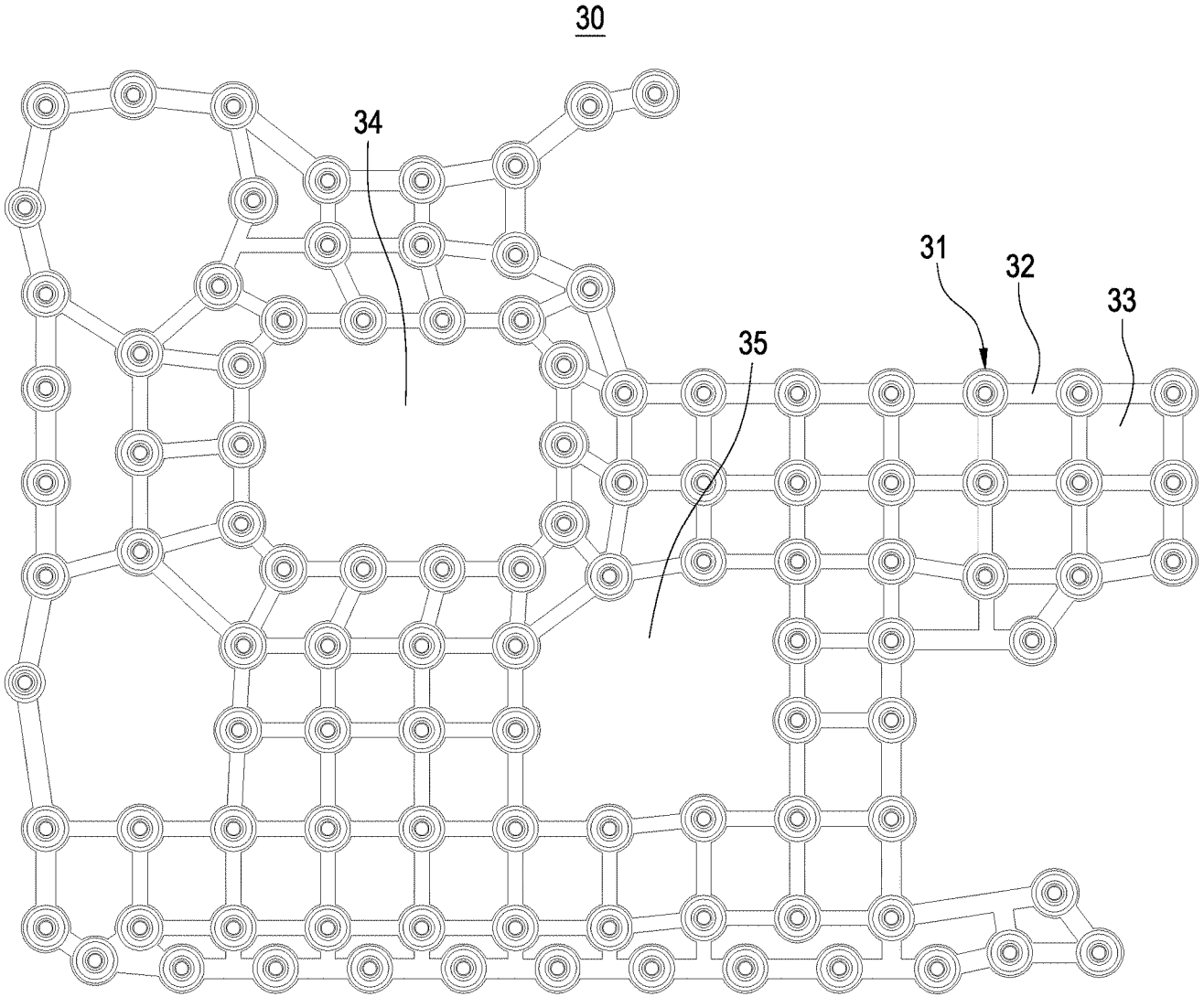
FIG. 5 is a top view of the single-piece support structure of the disclosure.
Figure 6:
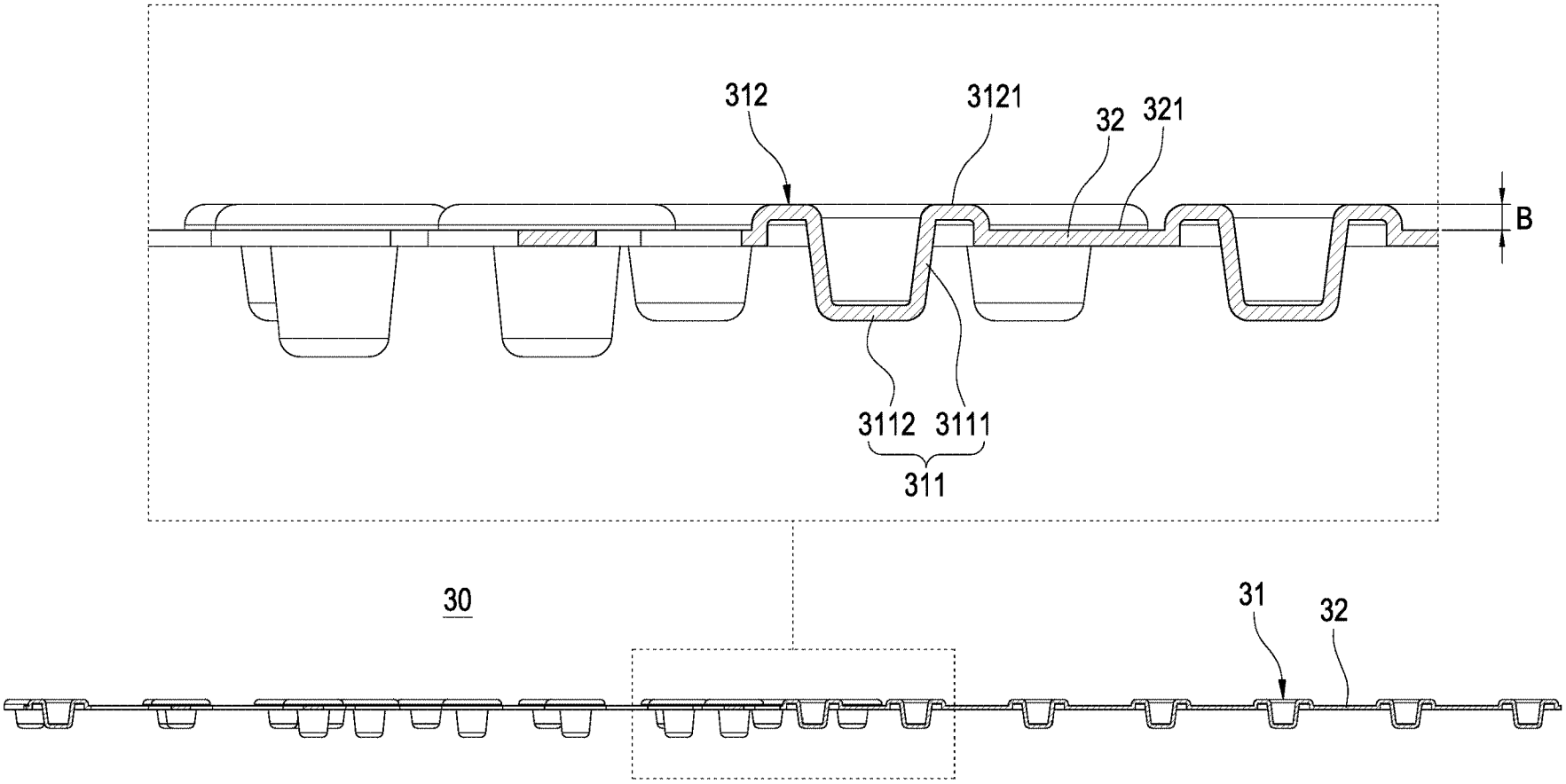
FIG. 6 is a cross-sectional view of the single-piece support structure of the disclosure.

Please refer to FIGS. 1 and 2. The disclosure provides a vapor chamber and a single-piece support structure thereof. The vapor chamber includes a shell body 10, a wick structure 20, a single-piece support structure 30 and a working fluid 40.

The shell body 10 includes a first shell 11 and a second shell 12. The first shell 11 and the second shell 12 are made of a material with desirable thermal conductivity such as copper, aluminum, magnesium, or an alloy thereof. The first shell 11 includes a bottom plate 111 and a surrounding plate 112 upward bent and extended from a periphery of the bottom plate 111. An end of the surrounding plate 112, which is away from the bottom plate 111, is outward extended with a flange 113. A specific position of the first shell 11 is disposed with multiple bumps 114 and a recess 115. The second shell 12 is correspondingly sealed with the first shell 11. A chamber A is formed between the first shell 11 and the second shell 12. After the second shell 12 and the first shell 11 are being sealed, the top of each bump 114 is tightly attached on the lower surface of the second shell 12.

The wick structure 20 is disposed in the chamber A and may be made of a material with desirable capillary adsorption, such as woven metal mesh, porous sintered powder, or fiber bundles. Its shape is approximately similar to the shape of the shell body 10. The wick structure of the embodiment includes a lower wick structure 21 and an upper wick structure 22. The lower wick structure 21 is attached on the first shell 11 and fixed on an inner surface of the first shell 11 by thermal diffusion welding. The upper wick structure 22 is attached on the second shell 12 and fixed on an inner surface of the second shell 12 by thermal diffusion welding. Each of the lower wick structure 21 and the upper wick structure 22 is disposed with multiple through holes 211, 221. The through holes 221 of the upper wick structure 22 are substantially arranged corresponding to the through holes 211 of the lower wick structure 21.

Please refer to FIGS. 3-6. The single-piece support structure 30 is disposed in the chamber A and between the first shell 11 and the second shell 12 and is formed by punching and blanking a plate with a stamping machine (not shown in figures). The single-piece support structure 30 includes multiple support bodies 31 and multiple ribs 32. Each support body 31 includes a hollow rod 311 and an annular seat 312 extended from the hollow rod 311. Any adjacent two of the annular seats 312 are connected by one of the ribs 32. The support bodies 31 are arranged at an interval. The ribs 32 are arranged along the support bodies 31 so as to form multiple hollow portions 33 between each support body 31 and each rib 32.

In an embodiment, one part of the ribs 32 are transversely arranged, another part of the ribs 32 are longitudinally arranged and still another part of the ribs 32 are aslant arranged.

In an embodiment, the hollow rod 311 has a conic portion 3111 and a bottom plate 3112 connected with the conic portion 3111. The annular seat 312 surrounds the top of the hollow rod 311 and has a substantially U-shaped cross-section. The hollow rods 311 are arranged in the same direction, so the ribs 32 are adjacent to, but not in contact with, the second shell 12. The annular seat 312 has a top 3121. The rib 32 has an upper surface 321. A height difference B is formed between the top 3121 of the annular seat 312 and the upper surface 321 of the rib 32.

In an embodiment, the single-piece support structure 30 further includes a first open area 34 and multiple second open areas 35. The vapor chamber of the disclosure further includes a main cooling zone H. The first open area 34 is formed in a region that is enclosed by a part of the hollow rods 311 and a part of the ribs 32 and is arranged corresponding to the main cooling zone H and the recess 115. Each second open area 35 is formed in a region that is enclosed by the other part of the hollow rods 311 and the other part of the ribs 32 and is arranged corresponding to each bump 114.

The working fluid 40 may be pure water and is filled in the chamber A. A degassing and sealing process is performed to make the chamber A form a vacuum chamber.

In an embodiment, the vapor chamber of the disclosure further includes a bonding layer 50 formed between the inner surface of the first shell 11 and the bottom plate 313 of the hollow rod 311 and formed between the inner surface of the second shell 12 and each annular seat 312.

The bonding layer 50 is a copper paste made of a copper powder base material mixed with an adhesive and is smeared on the bottom plate 3112 of each hollow rod 311 and the top 3121 of each annular seat 312. The copper paste forms the bonding layer 50 by each hollow rod 311 separately passing through each through hole 211 of the lower wick structure 21, each annular seat 312 separately passing through each through hole 221 of the upper wick structure 22 and performing heating, pressing, and connecting processes.

Figure 7:
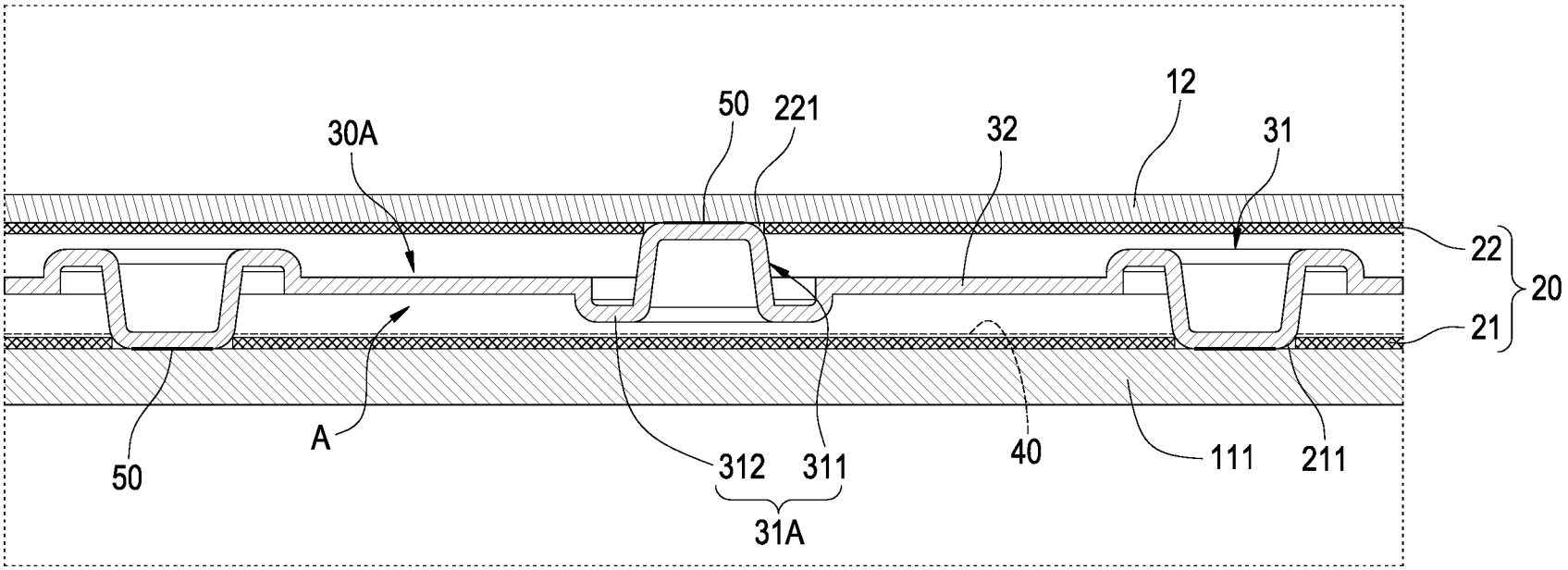
FIG. 7 is a partially cross-sectional view of another embodiment of the vapor chamber of the disclosure.

Please refer to FIG. 7. The single-piece support structure 30A of the embodiment has most of the features of the abovementioned single-piece support structure 30, and the difference is that adjacent two of the support bodies 31, 31A are arranged in opposite directions so as to make each rib 32 be at a middle position between the first shell 11 and the second shell 12.

While this disclosure has been described by means of specific embodiments, numerous modifications and variations could be made thereto by those skilled in the art without departing from the scope and spirit of this disclosure set forth in the claims.

What is claimed is:

1. A vapor chamber comprising:

a shell body, comprising a first shell and a second shell correspondingly sealed with the first shell, and a chamber defined between the first shell and the second shell;

a wick structure, disposed in the chamber, and attached on the shell body;

a single-piece support structure, disposed in the chamber and located between the first shell and the second shell, comprising multiple support bodies and multiple ribs, each support body comprising a hollow rod and an annular seat extended from the hollow rod, any adjacent two annular seats connected by one of the ribs, the support bodies arranged spacedly, and the ribs arranged along the support bodies to define multiple hollow portions between each support body and each rib; and a working fluid, disposed in the chamber.

2. The vapor chamber of claim 1, further comprising a bonding layer, wherein the hollow rod comprises a bottom plate, the annular seat comprises a top, and the bonding layer is disposed between the first shell and the bottom plate of the hollow rod and disposed between the second shell and the top of the annular seat.

3. The vapor chamber of claim 2, wherein the bonding layer is a copper paste made of a copper powder base material mixed with an adhesive.

4. The vapor chamber of claim 1, wherein one part of each rib is transversely arranged, another part of each rib is longitudinally arranged and still another part of each rib is aslant arranged.

5. The vapor chamber of claim 1, wherein the hollow rod comprises a conic portion and a bottom plate connected with the conic portion, the annular seat surrounds the hollow rod and is disposed away from the bottom plate, the annular seat comprises a top, the rib comprises an upper surface, and a height difference is defined between the top of the annular seat and the upper surface of the rib.

6. The vapor chamber of claim 1, wherein multiple hollow rods are arranged in a same direction to make the ribs adjacent to the second shell and free from contacting the second shell.

7. The vapor chamber of claim 1, wherein any adjacent two of the support bodies are arranged in opposite directions to make each rib be located at a middle position between the first shell and the second shell.

8. The vapor chamber of claim 1, wherein the wick structure comprises a lower wick structure and an upper wick structure, the lower wick structure is attached on the first shell, the upper wick structure is attached on the second shell, multiple through holes are defined on each of the lower wick structure and the upper wick structure, multiple hollow rods separately pass through the through holes of the lower wick structure, and multiple annular seats separately pass through the through holes of the upper wick structure.

9. The vapor chamber of claim 1, wherein the first shell comprises multiple bumps and a recess, the single-piece support structure further comprises a first open area and multiple second open areas, the vapor chamber comprises a main cooling zone, the first open area is defined in a region enclosed by a part of multiple hollow rods and a part of the ribs and is arranged corresponding to the main cooling zone and the recess, each second open area is defined in a region enclosed by another part of the hollow rods and another part of the ribs and is arranged corresponding to each bump.

10. A single-piece support structure of a vapor chamber, the vapor chamber comprising a first shell and a second shell, the single-piece support structure disposed between the first shell and the second shell and comprising multiple support bodies and multiple ribs, each support body comprising a hollow rod and an annular seat connected to the hollow rod, any adjacent two annular seats connected by one of the ribs, the support bodies arranged spacedly, and the ribs arranged along the support bodies to define multiple hollow portions between each support body and each rib.

* * * * *